US005711057A

United States Patent [19]

Dameron

[11] Patent Number: 5,711,057

[45] Date of Patent: Jan. 27, 1998

[54] CLAMPING APPARATUS HAVING SNAP-FITTING PIVOT STRUCTURE AND METHOD

[76] Inventor: Joseph Thomas Dameron, 5587 S. Country Club, Tucson, Ariz. 85706

[21] Appl. No.: 730,379

[22] Filed: Oct. 15, 1996

[51] Int. Cl.[6] ..... A44B 21/00; A47G 1/06; G09F 3/20

[52] U.S. Cl. ..... 24/499; 24/67 R; 24/67.11; 24/518; 24/498; 40/793

[58] Field of Search ..... 24/67 R, 67.3, 24/67.5, 67.11, 499, 517, 518; 40/647, 156, 13; 16/225, 790, 227, 792, 277, 293, 794, 795; 248/475.1, 498

[56] References Cited

U.S. PATENT DOCUMENTS

| | | | |
|---|---|---|---|
| 549,660 | 11/1895 | Rodden | 24/67.11 X |
| 2,363,355 | 11/1944 | Pitt | 24/67 R X |
| 2,538,509 | 1/1951 | Dorner | 24/250 |
| 2,796,646 | 6/1957 | Redka | 24/518 X |
| 2,979,842 | 4/1961 | De Ridder | 40/156 |
| 3,249,351 | 5/1966 | Smith | 269/236 |
| 3,833,970 | 9/1974 | Smith, Jr. | 24/67.5 |
| 4,194,635 | 3/1980 | Ferrara | 24/67.3 X |
| 4,237,632 | 12/1980 | Segerstad | 40/156 |
| 4,498,255 | 2/1985 | Heard | 40/156 |
| 4,523,400 | 6/1985 | Seely | 49/156 |
| 4,549,334 | 10/1985 | Miller | 24/518 X |
| 4,702,025 | 10/1987 | Mace | 40/156 |
| 4,835,891 | 6/1989 | Joffe | 40/647 |
| 4,864,699 | 9/1989 | Whitcomb | 24/499 |
| 4,899,974 | 2/1990 | Wear et al. | 24/67.11 X |
| 5,307,575 | 5/1994 | Ivansson et al. | 40/793 |
| 5,364,057 | 11/1994 | Pynenburg | 248/457 |
| 5,384,935 | 1/1995 | Maire-Hunke et al. | 24/67 R |
| 5,400,483 | 3/1995 | Noda | 24/499 |
| 5,584,461 | 12/1996 | Pynenburg | 24/498 X |
| 5,608,980 | 3/1997 | Pangeri | 40/793 |

*Primary Examiner*—Peter M. Cuomo
*Assistant Examiner*—Robert J. Sandy
*Attorney, Agent, or Firm*—LaRiviere, Grubman & Payne

[57] ABSTRACT

A clamp apparatus including a support member and a clamping arm member detachably and hingeally secured to the support member. The support member includes a first mating member of a hinge mechanism and the clamping am member includes a second mating member of the hinge mechanism. The clamp apparatus can not only rotatably and compressively clamp an elongate panel, or sheet object, or other material, but can be assembled by longitudinal engagement of the component members in a flanked, snap-fit manner. To facilitate the flanked, snap-fit formation of the hinge mechanism, the first mating member includes a resilient socket structure having an expandable opening for receiving the second mating member. The second mating member is more rigid than the socket structure, and is shaped having a V-shaped end portion for expanding the expandable opening of the socket structure, and a body portion shaped for detachably fitting within the socket structure in a compressed state for producing tension that effects clamping an object with a clamp end, or provide multiple self-supporting open positions. During assembly, the longitudinal members are positioned longitudinally flanking each other such that the V-shaped end of the longitudinal clamping arm member is in contact with the expandable opening of the longitudinal panel support member. The V-shaped end portion is then forced into the expandable opening until compressively engaged within the socket structure. The V-shaped end portion can pivot about the socket structure to facilitate placement of a panel object for being clamped.

8 Claims, 3 Drawing Sheets

CLAMPING APPARATUS HAVING SNAP-FITTING PIVOT STRUCTURE AND METHOD

FIELD OF THE INVENTION

The present invention relates to clamp mechanisms. More particularly, the present invention relates to pivot designs in clamp mechanisms. Even mere particularly, the present invention relates to pivot designs used in clamping elongated panel mecbanisms.

DESCRIPTION OF THE PRIOR ART

The pivot end of clamp mechanism has been patented as is evident from prior art patents concerning pivot clamp designs. Exemplary of patents concerning pivot clamp designs are: U.S. Pat. Nos. 2,538,509, 2,979,842, 3,249,351, 4,237,632, 4,498,255, 4,523,400, 4,702,025, 4,835,891, 4,864,699, and 5,364,057. U.S. Pat. No. 5,364,057 teaches a panel holder that includes panel members having longitudinal C-shaped flange structure along a peripheral edge. The longitudinal C-shaped flange structure on each panel members enables formation of a longitudinal hinge coupling by sliding action of one flange being received by the other. The longitudinal sliding action to form the hinge, as taught by U.S. Pat. No. 5,364,057, is viewed as a limitation for forming a longitudinal hinge on elongated panel holder in the building industry that would employ such design. In the building construction industry, a need exists for an elongated panel holder, that not only has a rotatable clamping arm that compressively holds an elongate panel, but that also has pivot structure that facilitates assembly of the clamp component members in a flanked, snap-fit manner to form a hinge. The length of the panels that are employed makes the use of end-to-end assembly sliding action impractical to use.

It is therefore a primary object of this invention to provide an elongate panel clamp apparatus having a pivot structure that facilitates forming a longitudinal hinge, by assembly of the clamp components in a flanked, snap-fit manner.

It is another object of this invention to provide a pivot structure for forming a hinge, in a flanked, snap-fit manner as well as in a flanked, hooked manner.

It is another object of this invention to provide a pivot structure for forming a hinge in a plurality of ways including forming a hinge in a flanked, snap-fit manner, in a flanked, hooked manner, as well as in hinge members sliding-in receiving manner.

It is yet another object of this invention to not only provide a pivot structure for forming a hinge in a plurality of ways, but to also provide a pivot structure that has multiple self-supporting positions away from the clamping position.

SUMMARY OF THE INVENTION

Accordingly, the foregoing objects are accomplished by a clamp apparatus comprising structure consisting of a support member and a clamping arm member detachably and hingedly secured to the support member. The support member comprises means for being fixedly attached to a fixed surface, and a first mating member of a hinge mechanism. The clamping arm member comprises a clamp end and a pivot end. The pivot end comprises a second mating member of the hinge mechanism. In accordance with the objects of the invention, the clamp apparatus comprises structure that rotatably and compressively clamps an elongate panel, or sheet object, and also has a hinge mechanism that can be formed by longitudinal engagement of the component members in a flanked, snap-fit manner. To facilitate the flanked, snap-fit formation of the hinge mechanism, the first mating member comprises a resilient socket structure having an expandable opening for receiving the second mating member. The second mating member comprises a lesser resilient structure, than the socket structure, that is shaped having an end portion for expanding the expandable opening of the socket structure, and a body portion shaped for detachably fitting within the socket structure in a compressed state for producing tension that effects clamping an object with the clampend. In the preferred embodiment, the first mating member, in the form of a socket structure with expandable opening, is provided on a peripheral edge of a longitudinal panel support member and the panel clamping arm member. The second mating member has a V-shaped second meting member, in the form of the lesser resilient structure described above, is provided on a peripheral edge of a longitudinal end portion that includes a tip end that facilitates initial entry into the expandable opening portion of the socket structure and further includes adjoining separating V-segments that contact and expand the expendable opening for seating the V-shaped end portion within the socket structure. The V-segments include a first segment that is one of the distal ends of the clamping arm member and that co-acts with a stop portion of the socket structure for retaining the clamping arm member within the socket structure, and a second segment that ends at a cam-like portion of the clamping arm member. In forming the hinge mechanism with the preferred embodiment, the longitudinal panel support member and the longitudinal panel clamping am member are positioned longitudinally flanking each other with the pivot end of the longitudinal clamping am member in contact with the expandable opening of the longitudinal panel support member. The V-shaped end portion is then forced into the expandable opening until the first and second V-segments are compressively engaged within the socket structure. In the compressed state of engagement, the V-shaped end portion can pivot about the socket structure to facilitate placement of a panel object for being clamped. The cam-like portion of the clamping arm member facilitates pivoting to an object clamping position, to multiple self-supporting open positions and to a complete open position. Detachment of the clamping arm member from the support member is effected, while in the complete open position, by an un-hooking disengagement action from the socket structure. The V-shaped pivot structure and associated socket structure facilitates forming a hinge in a plurality of ways including forming a hinge in a flanked, snap-fit manner, in a flanked, hooked manner, as well as in a sliding-in receiving manner if space permits. While the primary end use is to clamp sheet-like material, other clamping elements that employ the hinge structure of the present invention can clamp other geometrically shaped material.

Therefore, to the accomplishments of the foregoing object, the invention consists of the foregoing features hereinafter fully described and particularly pointed out in the claims, the accompanying drawings and the following disclosure describing in detail the invention, such drawings and disclosure illustrating but one of the various ways in which the invention my be practiced.

DESCRIPTION OF THE PREFERRED EMBODIMENT OF THE INVENTION

Figure 1:
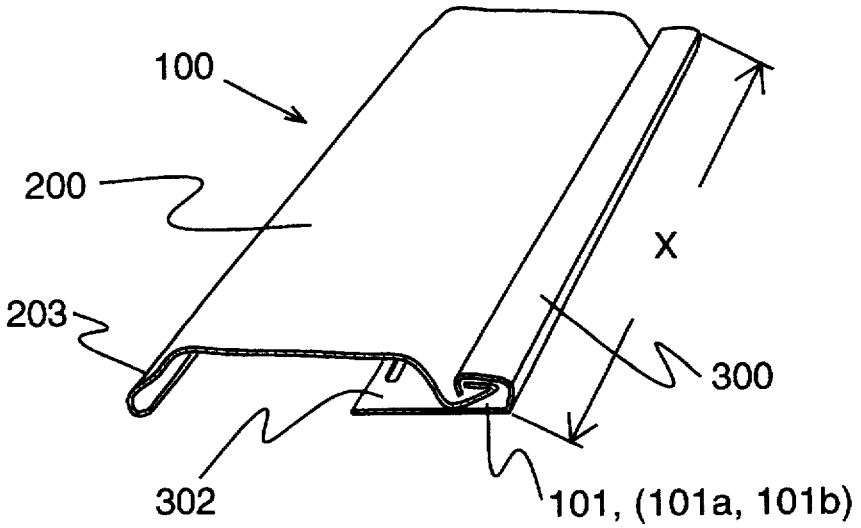
FIG. 1 is a perspective view of a clamping apparatus in accordance with the present invention showing the longitudinal panel support member and the longitudinal panel clamping arm member with a hinge mechanism in an assembled state.
Figure 2:
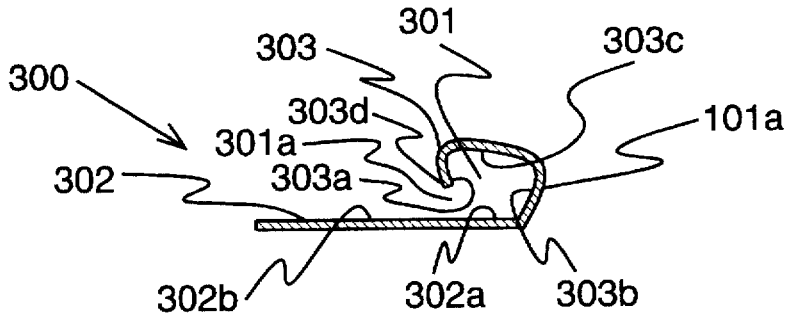
FIG. 2 is an end view of the longitudinal panel support member showing the socket structure and expandable opening of the first mating member of the hinge mechanism.
Figure 3:
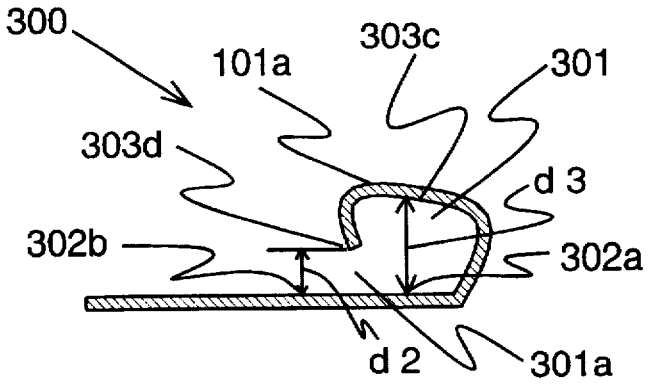
FIG. 3 is another end view of the longitudinal panel support member showing dimensional areas of concern for the socket structure and the expandable opening of the first mating member of the hinge mechanism.
Figure 4:
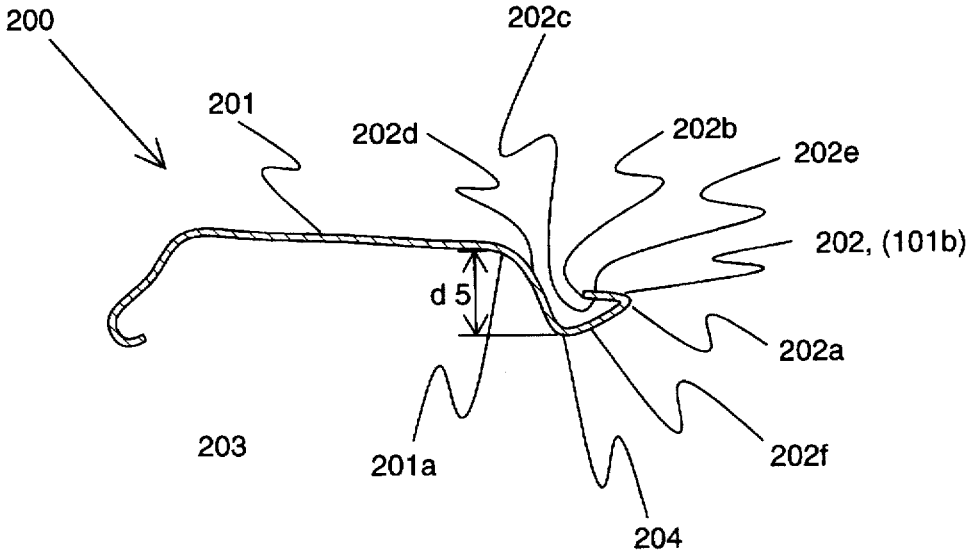
FIG. 4 is an end view of the longitudinal panel clamping arm member showing the clamp end, the V-shaped end portion of the pivot end of the second mating member of the hinge mechanism and the cam-like portion that helps produce tension for clamping a sheet-like object.
Figure 5:
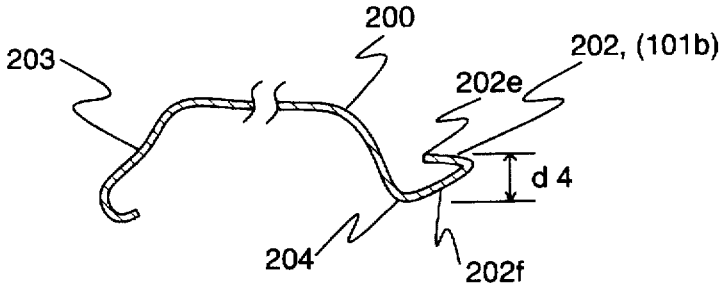
FIG. 5 another end view of the longitudinal panel clamping member showing a dimensional area of concern for the V-shaped end portion of the pivot end of the second mating member of the hinge mechanism.
Figure 6:
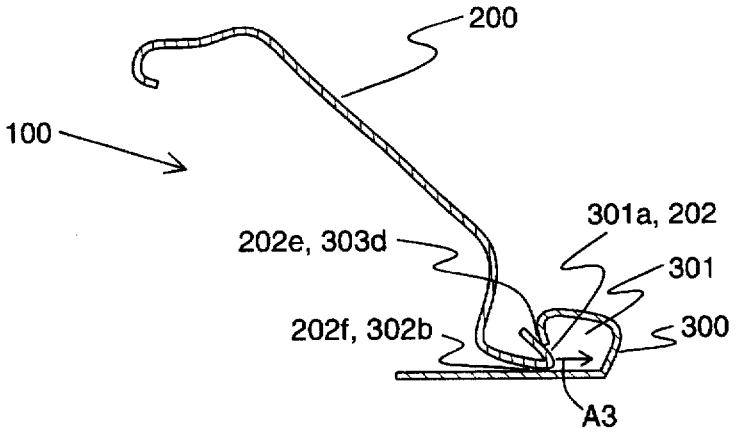
FIG. 6 is an end view of the clamping apparatus in accordance with the present invention showing the longitudinal panel support member and the longitudinal panel clamping arm member in an initial position for being assembled in a flanked, snap-fit manner.
Figure 7:
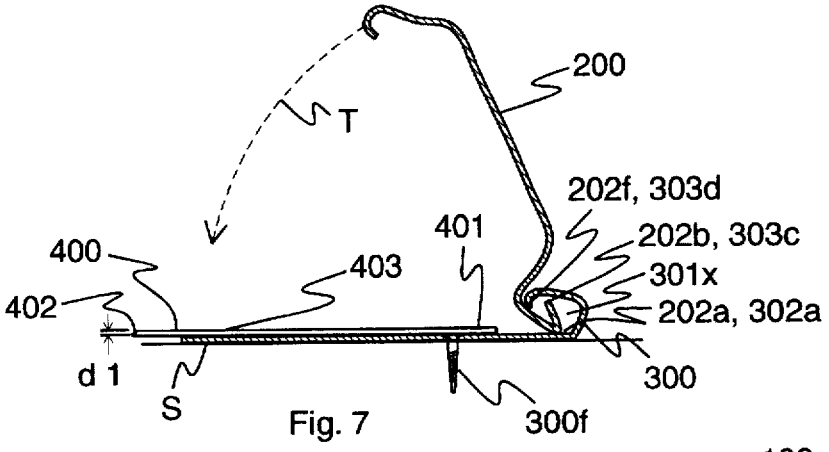
FIG. 7 an end view of the clamping apparatus in accordance with the present invention showing the longitudinal panel clamping arm member in a clamping action state towards a panel object robe clamped to the longitudinal panel support member.
Figure 8:
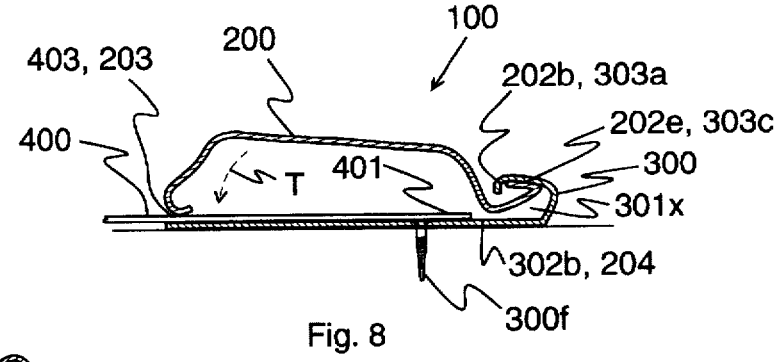
FIG. 8 is an end view of the clamping apparatus in accordance with the present invention showing the longitudinal panel clamping arm member clamping a panel object between it and the longitudinal panel support member.

FIG. 1 illustrates a clamp apparatus 100 comprising structure consisting of a support member 300 and a clamping am member 200 detachably and hingedly secured to support member 300. As best seen by referring to FIGS. 1, 2, 3, 7, 8, and 10, support member 300 comprises surface structure 302 for being fixedly attached to a fixed surface S using an attachment means 300*f*, and a first mating member 101*a* of hinge mechanism 101. Also, as best seen by referring to FIGS. 1, 4 and 5, clamping arm member 200 comprises a clamp end 203, an interconnecting portion 201 and a pivot end 101*b*. Pivot end 101*b* being a second mating member of hinge mechanism 101. Second mating member is also designated by numeral 101*b*. As illustrated in FIGS. 6 and 8, and in accordance with the objects of the invention, clamp apparatus 100 comprises structure 200, 300 that rotatably and compressively clamps an elongate panel, or sheet object, 400 as depicted by tension arrow T, (see FIGS. 7 and 8), and that also has a hinge mechanism 100 that can be formed by longitudinal engagement action, as depicted by arrow A3, of the component members in a flanked, snap-fit manner, (see FIG. 6).

Referring back to FIGS. 2, 3, 4, and 5, to facilitate the flanked, snap-fit formation of hinge mechanism 101, first mating member 101*a* comprises a socket structure 301, formed from a plastic resilient material, such as polyvinyl chloride, and having an expandable opening 301*a* for receiving second mating member 101*b*. Second mating member 101*b* is also formed from a plastic material, such as polyvinyl chloride, but differs from first mating member 101*a* in that it is less resilient, and thus can urge deformation of first mating member 101*a*, but is also slightly deformable due to its resilient properties. It is also possible to fabricate support member 300 and a clamping am member 200 from non-plastic materials such as aluminum. Thus, second mating member 101*b* is preferably shaped having a V-shaped end portion 202 and a body portions 202*a*, 202*b*, 202*c*, 202*e*, and 202*f* shaped for expanding expandable opening 301*a*and associated socket structure 303, 303*a*, and 303*d* (see FIG. 2 and 3). Body portions 202*a*, 202*b*, 202*c*, 202*e*, and 202*f* being shaped for detachably fitting within the socket structure 301 in a compressed state and producing tension T that effects clamping object 400 by clamp end 203 at a sheet section 403 located proximate end 402 of sheet object 400. In this regard, V-shaped end portion 202 has a height dimension d4, as measured across the V-segments 202*e*, 202*f*, see FIG. 5, that is greater than dimension d3 associated with the internal height of said socket structure 301, see FIG. 3. During insertion of V-shaped end portion 202 into socket structure 301, see generally FIG. 6, expandable opening 301*a* expands from a relaxed dimension d2, see FIG. 3, to at least the height dimension d4 associated with V-shaped end portion 202, see generally FIG. 5. Since tip end 202*a* of V-shaped end portion 202 has a height dimension that is less than d2, this facilitates initial entry into expandable opening portion 301*a* of socket structure 301. Also during insertion, the separating V-segments 202*e*, 202*f* contact socket portions 303*d*, 302*b*, respectively, and expand expandable opening 301*a* from dimension d2 to at least dimension d4, as discussed above. Since second mating member 101*b* is resilient, V-segments 202*e* and 202*f* are compressible towards each other to further facilitate seating the V-shaped end portion 202 within socket structure 301. As discussed above, and as best seen in FIGS. 4, 5, 6, and 8, V-shaped end portion 202 includes a first V-segment 202*e* that is one of the distal ends of the clamping arm member 200 and that includes butt end 202*b* that co-acts with stop portion 303*a* of socket structure 301 for retaining clamping arm member 200 within socket structure 301, and a second V-segment 202*f* that ends at a cam-like portion 204 of clamping arm member 200. Cam-like portion 204 extends to interconnecting section 201 by way of riser segment 202*d* which ends at curved portion 201*a*. Segment 202*d* rises a distance d5 from portion 204 and defines a clearance space beneath clamping arm member 200. It should be noted that at end 401 of sheet object 400, d5 must be equal to or greater than d1 which is the thickness of sheet object 400.

Figure 9:
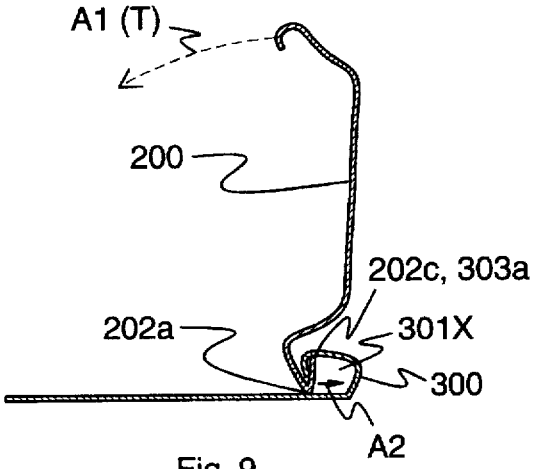
FIG. 9 an end view of the clamping apparatus in accordance with the present invention showing the longitudinal panel clamping arm member in a break-over vertically position with respect to the longitudinal panel support member.

In forming hinge mechanism 101 with the preferred embodiment, the longitudinal panel support member 300 and the longitudinal panel clamping arm member 200 are positioned longitudinally flanking each other with the pivot end 10l*b* of the longitudinal clamping arm member 200 in contact with the expandable opening 301*a* of the longitudinal panel support member 300. The V-shaped end 202 portion is then forced into the expandable opening 301*a*, as depicted in FIG. 6, until V-segments 202*e* and 202*f* are compressively engaged within socket structure 301, depicted also as 301X to indicate an expanded socket structure state. In the compressed state of engagement, V-shaped end portions 202*a*, 202*b*, 202*c*, 202*e* and 202*f* can pivot about the socket structure 303*a*, 303*b*, 303*c* and 302*a*, as depicted by action arrow A2 in FIG. 9, to facilitate placement and clamping a panel object 400, see also FIGS. 2, 7, 8, and 10. As best seen by referring to FIGS. 7 and 10, clamping arm member 200 can pivoting as action A1, at a complete open position, and pivot under tensioning action T during closing and maintain tension T while in a closed, clamping position, as well as multiple self-supporting open positions away from the clamped position. FIG. 9 shows that tensioning action T begins at a break-over vertical alignment position of socket portion 303*a* with wall portion 202*c* of V-shaped portion 202.

Figure 10:
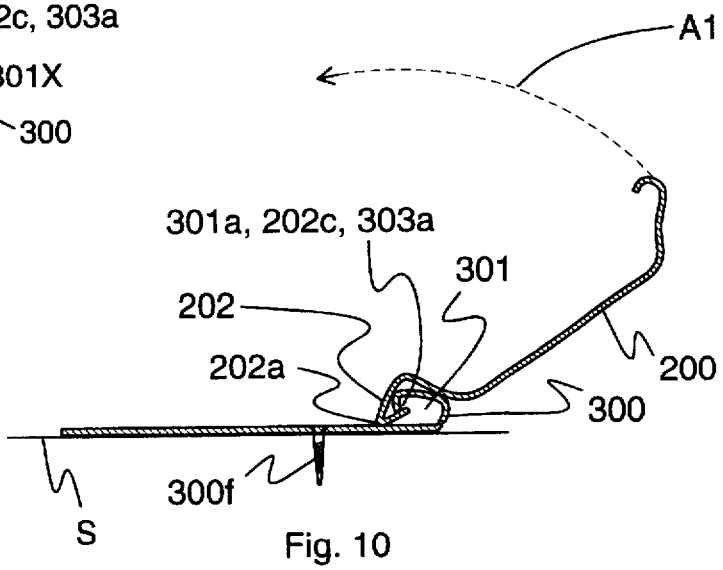
FIG. 10 is an end view of the clamping apparatus in accordance with the present invention showing the longitudinal panel clamping arm member in a complete open, un-tensioned position with respect to the longitudinal panel support member ready for closing or disengagement from the socket structure, or for longitudinal hook-type engagement.

Detachment of clamping arm member 200 from the support member 300 is effected, while in the open position, by an un-hooking disengagement action from the socket structure 301, see generally FIG. 10. The V-shaped pivot structure 202 and associated socket structure 301 facilitates forming hinge mechanism 101 in a plurality of ways including forming a hinge in a flanked, snap-fit manner as described above, in a flanked, hooked manner, essentially as shown in FIG. 10, as well as in a sliding-in receiving manner, (not shown) but comprising and end of socket structure 301 in linear alignment with an end of V-shaped portion 202, substantially as shown in FIG. 8.

Therefore, while the present invention has been shown and described herein in what is believed to be the most practical and preferred embodiment, it is recognized that departures can be made there from within the scope of the invention, which is therefore not robe limited to the details disclosed herein but is to be accorded the full scope of the claims so as to embrace any and all equivalent apparatus.

I claim:

1. A clamp apparatus, said apparatus comprising:

a longitudinal support member; and a longitudinal clamping arm member, said clamping arm member being detachably and hingedly secured to said support member by a hinge mechanism, said support member comprising a first mating member of said hinge mechanism, and said clamping arm member comprising a second mating member of said hinge mechanism, and said hinge mechanism being formed by longitudinal, snap-fit engagement of said first mating member with said second mating member; and said first mating member comprising a resilient socket structure including an expandable opening for receiving said second mating member; and said second mating member comprises a V-shaped end portion having a tip end for entering said expandable opening from a longitudinal direction approximately parallel to said support member, and also having V-segments that expand said expandable opening for detachably fitting said V-shaped end portion within said resilient socket structure in a compressed state and for forming said hinge mechanism and for producing tension that effects clamping an object to a clamp end of said longitudinal clamping arm member.

2. A longitudinal hinge apparatus, said apparatus comprising:

a longitudinal support member having a first mating member of said hinge apparatus; and a longitudinal clamping arm member having a second mating member of said hinge apparatus, said first mating member comprising a resilient socket structure that includes an expandable opening for receiving said second mating member, and said second mating member comprising a V-shaped end portion having a tip end for entering said expandable opening, and also having V-segments for expanding said expandable opening and detachably fitting said V-shaped end portion within said resilient socket structure in a compressed state, said hinge apparatus being formed by longitudinal snap-fit engagement of said second mating member to said first mating member by inserting tip end of said V-shaped end portion into said resilient socket structure.

3. A longitudinal hinge apparatus, as described in claim 2, wherein:

said second mating member further comprises a cam-like portion for producing clamping tension upon being disposed within said resilient socket structure.

4. A longitudinal hinge apparatus, as described in claim 2, wherein:

said V-segments include a first segment that is one of the distal ends of said clamping arm member and that co-acts with a stop portion of said socket structure for retaining said clamping arm member within said socket structure, and a second segment that ends at a cam-like portion of said clamping arm member.

5. A longitudinal hinge apparatus, as described in claim 2, wherein:

said V-shaped end portion having a dimension, as measured across said V-segments, that is greater than a dimension associated said expandable opening, and also greater than an internal height dimension of said socket structure.

6. A method of forming a longitudinal hinge apparatus, said method comprising the steps of:

(a) providing a longitudinal support member having a first mating member of said hinge apparatus;

(b) providing a longitudinal clamping arm member having a second mating member of said hinge apparatus, said first mating member comprising a resilient socket structure that includes an expandable opening for receiving said second mating member, and said second mating member comprising a V-shaped end portion having a tip end for entering said expandable opening, and also having V-segments for expanding said expandable opening and detachably fitting said V-shaped end portion within said resilient socket structure in a compressed state;

(c) positioning said longitudinal support member and said longitudinal clamping arm member longitudinally flanking each other such that said V-shaped end portion is in contact with said expandable opening.

(d) forcing said V-shaped tip end portion directly into said expandable opening of said support member;

(e) expanding said expandable opening by pressing said V-segments further into said expandable opening; and (f) compressively engaging said V-shaped end portion within said resilient socket structure resulting in forming said longitudinal hinge apparatus.

7. A method of forming a longitudinal hinge apparatus as described in claim 6, said method further comprising the steps of:

(g) pivoting said longitudinal clamping arm member about said socket structure;

(h) clamping a panel object beneath said longitudinal clamping arm member; and (i) detaching said longitudinal clamping arm member from said longitudinal support member by an un-hooking disengagement action from the socket structure while said longitudinal clamping arm member is in an open position.

8. A method of forming a longitudinal hinge apparatus as described in claim 7, wherein:

said step (g) comprises producing multiple self-supporting open position allowing easy access to panel objects beneath longitudinal clamping arm member.

* * * * *